US005259848A

United States Patent [19]

Terry et al.

[11] Patent Number: 5,259,848

[45] Date of Patent: Nov. 9, 1993

[54] METHOD FOR REMOVING STAINS FROM CARPET AND TEXTILES

[75] Inventors: C. Edward Terry, Kennesaw; Daniel F. Pinholster, Jr., Cartersville, both of Ga.

[73] Assignee: Interface, Inc., Atlanta, Ga.

[21] Appl. No.: 678,895

[22] Filed: Mar. 28, 1991

Related U.S. Application Data

[63] Continuation-in-part of Ser. No. 535,843, Jun. 11, 1990, abandoned.

[51] Int. Cl.[5] ..... D06L 3/02

[52] U.S. Cl. ..... 8/111; 8/101; 252/98; 252/99; 252/102

[58] Field of Search ..... 252/98, 102, 156, DIG. 19, 252/554, 558, 559; 8/111

[56] References Cited

U.S. PATENT DOCUMENTS

| | | | |
|---|---|---|---|
| 355,523 | 1/1887 | Harrison | 252/98 |
| 3,811,833 | 5/1974 | Stalter | 252/98 |
| 4,113,645 | 9/1978 | DeSimone | 252/186.44 |
| 4,525,292 | 6/1985 | Cushman et al. | 252/98 |
| 4,594,184 | 6/1986 | Cook et al. | 252/98 |

FOREIGN PATENT DOCUMENTS 0346835 12/1989 European Pat. Off. .

OTHER PUBLICATIONS

Hall, J. L., et al., *Chemical Abstract* 109:14593b (1988).
Fukumasu, A., *Chemical Abstract* 109:134827c (1988).
Yamamoto, N., et al., *Chemical Abstract* 92:24625h (1980).
Fukumasu, A., et al., *Chemical Abstract* 110:141247n (1988).
Sadowski, T., et al., *Chemical Abstract* 101:41081v (1983).

*Primary Examiner*—Prince Willis, Jr.
*Assistant Examiner*—John F. McNally
*Attorney, Agent, or Firm*—Kilpatrick & Cody

[57] ABSTRACT

A method to remove stubborn stains that includes application of an ammonium salt in combination with a peroxide. In the preferred embodiment, the stain removing solution contains ammonium bicarbonate and peroxide. A major advantage of the method is that the solution is strong enough to remove coffee and tea stains yet sufficiently mild that it does not damage the carpet or pose a significant health hazard to the person treating the stain.

15 Claims, No Drawings

METHOD FOR REMOVING STAINS FROM CARPET AND TEXTILES

This application is a continuation-in-part application of U.S. Ser. No. 07/535,843, filed on Jun. 11, 1990 now abandoned.

This invention is in the general area of carpet and textiles, and is specifically a method to remove stains from fibers.

It is estimated that 75% of all carpet currently produced in the United States, and 46% of all carpet produced in Europe, is prepared from nylon fiber. Nylon fiber is also used extensively in upholstery and fabric coverings. Nylon is constructed of polyamide polymers. Carpet and textile fibers are also often constructed from polyester and polypropylene.

Carpets and other textile products are easily stained by exposure to common household and industrial materials. In fact, it has been determined that more carpets are replaced because they are stained than because the fibers are worn.

The way in which a carpet or textile stains is highly influenced by its polymeric construction. Coffee and tea permanently stain nylon fiber. It appears that the mechanism of coffee staining involves the simple absorption of the coffee components into the nylon fiber. Nylon fiber is also easily stained by acid dyes. Common substances that contain acid dyes include mustard, wine, and soft drinks that contain FD&C red dye No. 40. The mechanism of staining of nylon fiber by acid dyes appears to involve the formation of ionic bonds between the protonated terminal amines on the polyamide fiber and the anionic material (acid dye).

Polyolefins, such as polyethylene and polypropylene, and polyester do not have active sites and therefore stain primarily by simple absorption of the staining material into the fiber. These fibers are also easily stained by coffee and tea.

Carpet and textiles are now treated against stains in several ways. The fiber can be treated before use to prevent staining or can be treated to remove stains after they have occurred. Carpet and textile coating compositions are not presently adequate to prevent permanent staining by various materials. Therefore, it is important to have an effective process to remove stubborn stains from carpets and textiles after they have occurred. It is also important that the process be mild enough not harm the carpet or textile fibers or the dyes attached to the fibers.

Many types of compositions are sold to remove stains from carpet and textiles. Common components of these stain removing solutions are trichloroethane, toluene, petroleum naphtha, methylene chloride, xylene and derivatives of xylene, surfactants, ethoxylates, sulfates and detergents. These are commonly applied in a fluorocarbon aerosol. However, none of these compositions are suitable to remove very stubborn stains, such as those from coffee and tea.

It is also known to use a solution of ammonia and hydrogen peroxide to remove carpet stains. This composition appears to be effective in removing very stubborn stains, including those from coffee and tea. However, the solution emits an odor that is quite noxious and toxic. Companies are very hesitant to request their technical field personnel to use such a harsh product. When it is used in significant quantities, the room must be ventilated to remove the harmful odors. Further, ammonium hydroxide (the ammonia species existing in aqueous solution) is a very strong base (pH 12) that can change the color of stock dyed carpet by extraction of the dye or by chemical reaction. Ammonium hydroxide can also weaken the latex adhesive used in carpets. Another major disadvantage of this method is that the ammonia solution is so strong that it will react with some staining materials. For example, in certain cases, when the ammonia based solution is applied to a stain, a noticeable reaction occurs that includes the emission of smoke or fume as well as heat generation.

Therefore, it is an object of the present invention to provide a method to remove stains from carpet and textiles.

It is another object of the present invention to provide a method to remove stains from carpet and textiles that is effective on both coffee and tea stains.

It is a further object of the present invention to provide a method to remove stains from carpet and textiles that does not involve noxious or toxic odors.

It is yet another object of the present invention to provide a method to remove stains from carpet and textiles that is sufficiently mild that it does not adversely affect carpet or textile fibers, or materials to which the fiber is attached.

SUMMARY OF THE INVENTION

A method to remove stubborn stains is provided that includes application of an ammonium salt, preferably ammonium bicarbonate or ammonium carbonate, in combination with a peroxide and a fluorinated alkyl sulfonic acid. A major advantage of the method is that the solution is strong enough to remove coffee and tea stains yet sufficiently mild that it does not damage the carpet or pose a risk of danger to the person treating the stain.

DETAILED DESCRIPTION OF THE INVENTION

The present invention is a method to remove stubborn stains from carpet and textiles that includes application of an ammonium salt, preferably ammonium bicarbonate or ammonium carbonate in combination with peroxide and a fluorinated alkyl sulfonic acid. This method is effective to remove stubborn stains, including those from berries, blood, catsup, coffee, tea, fruit drinks, fruit juice, liquor, shoe polish, soft drinks, and red wine.

Peroxide is an active component of the stain removing formulation. The preferred peroxide is hydrogen peroxide. Hydrogen peroxide is stable in acid, but decomposes in base to form reactive species that attack the staining material and cause it to break down. For example, most colored staining materials have a chromophore consisting of a series of alkenyl linkages. Hydroxyl radicals react with the alkenyl bonds of the colored compound, oxidizing the molecule at that point, disrupting the chromophore.

It was very surprising to discover that weak ammonium salts are effective in removing stubborn stains when used in combination with hydrogen peroxide. The ammonium salt increases the pH of the solution to approximately pH 7.0, preferably in the range of 7.0 to 10.5. As described above, the prior art suggests that a strong base such as ammonia itself (pH 12) is necessary to sufficiently activate the peroxide to remove stubborn stains.

An advantage of the new method is that it is less harmful to the stained carpet or fabric than the very basic ammonia solution now used to remove these stains. The solution will not significantly weaken the latex backing of the carpet.

This method is also less toxic to the persons applying the solution than the prior art method. It does not produce significant amounts of annoying and toxic fumes that must be eliminated by forced ventilation of the room. Further, the weaker ammonium salts will not react unpredictably with the wide variety of staining materials, as the stronger ammonia solution does, causing harmful odors and generating heat of reaction. Another advantage of this method is that the ammonium salts will not burn the skin on handling as ammonia can.

In the preferred embodiment, a solution of ammonium bicarbonate or carbonate and a fluorinated alkyl sulfonic acid ("Part A") is mixed just prior to use with a solution of hydrogen peroxide ("Part B"). A small amount of the combined solution is then applied to the carpet or textile in an inconspicuous place to insure that it does not damage the fiber. On determining that the solution is safe for the fiber, all of the free residue of the stain is removed, and the mixture is then applied to the stain in any convenient manner, including by spray bottle or by blotting it onto the stain. The stain should be saturated with the mixture, however, care must be taken not to overwet the carpet. The mixture should remain on the carpet until either the stain has been removed, or until the area has dried. If necessary, the procedure is repeated until the stain is removed.

If ammonium bicarbonate or ammonium carbonate and hydrogen peroxide are used in the stain removing solution, the solution does not have to be removed after application, because both ammonium bicarbonate (or ammonium carbonate) and hydrogen peroxide degrade into compounds that evaporate from the fiber.

The two components of the stain remover, Part A (containing the ammonium salt) and Part B (containing peroxide) are described in more detail below.

Part A of the Stain Remover

Any solvent is appropriate for use in the Part A solution that is compatible with the ammonium salt and that does not adversely affect the stain resisting properties of the combination of Part A and Part B. It is preferred that a solvent be used that evaporates easily, in a matter of hours, leaving little or no residue.

A preferred solvent is water or a mixture of water and alcohol. Alcohols facilitate the penetration, or "wetting out" of solution into the yarns. Preferred alcohols are the lower molecular weight alcohols, such as methyl, ethyl, propyl, isopropyl, isobutyl, sec-butyl, and t-butyl alcohol. Combinations of alcohols can also be used. A fragrance can be added to the solvent to give the solution a pleasant odor.

Part A of the stain removing composition includes as the active ingredient an ammonium salt. The preferred ammonium salts are ammonium bicarbonate ($NH_4HCO_3$) and ammonium carbonate ($(NH_4)_2)CO_3$). Nonlimiting examples of other ammonium salts that can be used in the Part A solution include ammonium acetate ($NH_4(C_2H_3O_2)$), ammonium phosphate ($(NH_4)_2HPO_4$), ammonium carbamate ($NH_4CO_2NH_2$), ammonium chloride ($NH_4Cl$), ammonium citrate ($(NH_4)_2HC_6H_5O_7$), ammonium laurate ($C_{11}H_{23}COONH_4$), ammonium oxalate ($(NH_4)_2C_2O_4$), ammonium persulfate ($(NH_4)_2S_2O_8$), ammonium sulfate ($(NH_4)_2SO_4$, ammonium tartrate ($(NH_4)_2C_4H_4O_6$), and ammonium formate ($HCO_2NH_4$). Mixtures of ammonium compounds can also be used. Ammonium bicarbonate and ammonium carbonate are preferred because they do not leave a residue, but instead break down into volatile products (ammonia and carbon dioxide).

Contemplated equivalents of ammonium salts are all other amines that provide a pH range of between approximately 7.0 and 10.5, activate peroxide, are nontoxic under the conditions of use, and do not emit significant fumes in the presence of hydrogen peroxide or react with volatility when combined with staining materials. Examples include aliphatic amines, and morpholines. If a compound is used that leaves a residue on the fiber after the stain is removed, the residue can be easily removed by application of water, alcohol, or a dry cleaning solvent such as methylene chloride, or trichloroethane, toluene, petroleum naphtha, xylene or a derivative of xylene, acetone, or a surfactant, ethoxylate, sulfate or detergent.

A surface active agent can also be added to the Part A solution to improve the wettability of the fiber and to act as a detergent. A suitable surface active agent, or surfactant, is any compound that reduces surface tension when dissolved in water or a water solution, or that reduces interfacial tension between the solution and the fiber. Surfactants suitable for use in the stain removing formulation cannot adversely react with the fiber or either the Part A or Part B solution. The surfactant can be a cationic, nonionic, or anionic compound, including the salts of sulfated fatty alcohols, salts of alkyl aromatic sulfates, ethoxylated amines, quaternary amines, ethoxylated fatty alcohols, ethoxylated alkyl phenols, and ethoxylated quaternary amines.

A preferred surfactant is a fluorinated alkyl sulfonic acid. The term "fluorinated alkyl" as used herein, refers to a $C_1$ to $C_{25}$ alkyl group in which at least two hydrogen atoms are replaced with fluorine. A preferred formula is $R_f—CH_2CH_2—SO_3H$ wherein $R_f=F(CF)_n$ where n=3 to 17, preferably 6 to 10, or its coordinate salt. A suitable commercial product is Zonyl TBS fluorosurfactant, sold by E.I. DuPont de Nemours & Co., Inc., containing 30–35% perfluoroalkyl sulfonic acid, ammonium salt, and 2–4% acetic acid. Coordinate salts include any salt of the sulfonic acid that does not adversely affect the performance of the acid in the stain removing solution, including the ammonium, sodium, or potassium salt. The fluorinated alkyl sulfonic acid reduces the later wetting of the fiber surface by minimizing chemical contact between the surface and substances that can oil the fiber, making the substance easier to remove. When used on nylon (polyamide) fiber, it may also impart stain resistance to the fiber by ionically bonding to terminal amine sites, preventing the later attachment of staining acid dyes such as those found in colored fruit and soft drinks. Other preferred fluorocarbon surfactants are perfluoro aliphatic oxybenzene sulfonic acid salts.

A preferred concentration of ammonium salt in the Part A solution is between 3% to 25% by weight. The concentration of surfactant in the Part A solution is preferably in the range of 0% to 1.0%, or a minimal amount necessary to wet out the carpet yarn. A preferable concentration of alcohol is from 0% to 20%. The ingredients in the Part A solution can be mixed with the Part B solution in any ratio that is effective to remove stains.

Part B Solution

The Part B solution includes a source of peroxide as an oxidant in a solvent. The preferred peroxide is hydrogen peroxide because it does not leave a residue on the fiber, as it breaks down to volatile products on reaction with the ammonium salt. Other peroxides that can be used are water soluble organic peroxides, such as t-butyl hydroperoxide, and inorganic peroxides. Other oxidants such as ammonium perchlorate and ammonium persulfate can also be used in place of peroxide.

Any concentration of peroxide can be used that is effective to remove stains when combined with the Part A solution and that does not damage the fiber or any material that it is attached to. The concentration of peroxide in the Part B solution is preferably between 3% and 35%.

The following examples further illustrate the method to remove stubborn stains from carpet or textiles.

EXAMPLE 1

Preparation of Stain Removing Composition

The Part A solution is prepared in small or large batch by mixing the following ingredients in the order listed. The solution is stirred until all components are dissolved.

| | | |
|---|---|---|
| 1. Water | 90.000 | 360.00 |
| 2. Ammonium Bicarbonate | 4.985 | 20.00 |
| 3. Isopropanol | 5.000 | 20.00 |
| 4. Zonyl TBS | 0.010 | 0.04 |
| 5. Lemon Fragrance K-6750 | 0.005 | 0.02 |
| | 100.000 | 400.00 |

This Part A solution is a clear, colorless liquid with a lemon odor.

The Part B solution is prepared in a separate hydrogen peroxide approved container, by mixing the following ingredients in the following order.

| | | |
|---|---|---|
| 1. Water | 45.600 | 205.00 |
| 2. 35% Hydrogen Peroxide | 54.400 | 245.00 |
| | 100.000 | 450.00 |

The Part B solution is a clear, colorless liquid containing approximately 19% hydrogen peroxide.

EXAMPLE 2

Preparation of Stain Removing Composition

The Part A solution is prepared in small or large batch by mixing the following ingredients by weight in the order listed. The solution is stirred until all of the components are dissolved.

| | |
|---|---|
| 1. Deionized water | 95.1 |
| 2. Ammonium Bicarbonate | 4.9 |
| 3. Fluorinated Alkyl Sulfonic Acid | 0.01 |
| 4. Fragrance | 0.005 |

The Part B solution is prepared in a separate hydrogen peroxide approved container, by mixing the following ingredients in the following order.

| | |
|---|---|
| 1. Deionized water | 77.3 |

-continued

| | |
|---|---|
| 2. 35% Hydrogen Peroxide | 22.7 |

The Part B solution is a clear, colorless liquid containing approximately 8% hydrogen peroxide by weight.

EXAMPLE 3

Removal of Coffee Stains from Nylon Carpet

A coffee stain on nylon carpet is removed with the following procedure. One part by weight of the Part A solution is mixed with one part by weight of the Part B solution as prepared in Example 1. After most of the coffee residue from the spill has been removed from the carpet fiber, the stain removing solution is applied from a spray bottle, taking care to saturate the stain without overwetting the carpet. The solution is allowed to remain on the carpet until either the stain has been removed, or until the area has dried. If the stain persists, repeat the procedure. The coffee stain is substantially removed.

EXAMPLE 4

Removal of Tea Stains from Nylon Carpet Fibers

The same method described in Example 3 is used to remove tea stains from nylon (polyamide) carpet fibers.

Modifications and variations of the present invention for the method of removing stains from carpets and textiles will be obvious to those skilled in the art from the foregoing detailed description of the invention. Such modifications and variations are intended to come within the scope of the appended claims.

We claim:

1. A method for removing stains from carpet fibers and textile fibers comprising applying a aqueous solution that includes an effective stain removing amount of:

(i) ammonium bicarbonate or carbonate, (ii) an oxidant selected from the group consisting of peroxide, ammonium perchlorate and ammonium persulfate, and (iii) a fluorinated alkyl sulfonic acid or its salt, wherein the fluorinated alkyl is a $C_1$ to $C_{25}$ alkyl group in which at least two hydrogen atoms are replaced with fluorine wherein said ammonium bicarbonate or carbonate is present in an amount sufficient to provide a pH between about 7.0 to about 10.5 to the solution.

2. The method of claim 1, wherein the solution further comprises a fragrance.

3. The method of claim 2, wherein the fragrance is lemon.

4. The method of claim 1 used to remove a stain selected from the group consisting of berries, blood, catsup, coffee, dyes, fruit drinks, fruit juice, ink, liquor, mustard, shoe polish, soft drinks, and red wine.

5. The method of claim 1, wherein the pH of the solution is between approximately 7.0 and 10.5.

6. The method of claim 5, wherein the fluorinated alkyl sulfonic acid surfactant is of the formula $R_f—CH_2CH_2—SO_3H$ wherein $R_f=F(CF)_n$ wherein n=3 to 17.

7. The method of claim 1, further comprising separately preparing the ammonium bicarbonate or carbonate solution and the oxidant solution, and then mixing the two solutions just prior to use.

8. The method of claim 7 wherein the concentration of ammonium carbonate or bicarbonate is from 4% to 25% by weight in the solution.

9. The method of claim 7, wherein the concentration of peroxide in the oxidant solution is between 3 and 35%.

10. The method of claim 1, wherein the fluorinated alkyl sulfonic acid is present as its salt.

11. The method of claim 10, wherein the salt is selected from the group consisting of the sodium, potassium and ammonium fluorinated alkyl sulfonic acid.

12. The method of claim 1 wherein the fiber is a polyamide.

13. The method of claim 1, wherein the oxidant is hydrogen peroxide.

14. The method of claim 1, (i) is ammonium carbonate.

15. The method of claim 1, (i) is ammonium bicarbonate.

* * * * *